United States Patent [19]

Inagaki

[11] Patent Number: 5,031,244

[45] Date of Patent: Jul. 16, 1991

[54] MESHY GARMENT

[76] Inventor: Jitsuo Inagaki, 71, Aza Kamiyashiki, Oaz Itsusiki, Itsusikicho Hazugun Aichi, Japan

[21] Appl. No.: 312,828

[22] Filed: Feb. 21, 1989

[51] Int. Cl.[5] ..... A41D 1/04

[52] U.S. Cl. ..... 2/102; 2/94; 2/DIG. 1

[58] Field of Search ..... 2/94, DIG. 1, 102, 247, 2/251; 126/204

[56] References Cited

U.S. PATENT DOCUMENTS

| | | | |
|---|---|---|---|
| 683,029 | 9/1901 | Estes | 2/251 |
| 779,898 | 1/1905 | Yates | 2/247 |
| 796,711 | 8/1905 | Ferguson | 2/94 |
| 902,084 | 10/1908 | Hyltén-Cavallius | 2/102 |
| 1,723,214 | 8/1929 | Smith | 2/94 |
| 1,869,261 | 7/1932 | Jennings | 2/94 |
| 2,066,072 | 12/1936 | Powell | 2/94 X |
| 2,448,416 | 8/1948 | Carter | 2/94 |
| 3,476,102 | 11/1969 | Sarnoff | 126/204 |
| 3,885,248 | 5/1975 | Salsby | 2/46 X |
| 4,535,482 | 8/1985 | Spector et al. | 2/160 |
| 4,658,442 | 4/1987 | Tomlinson et al. | 2/102 X |
| 4,796,304 | 1/1989 | Shelby | 2/102 X |

FOREIGN PATENT DOCUMENTS

| | | | |
|---|---|---|---|
| 192334 | 11/1907 | Fed. Rep. of Germany | 2/102 |
| 49194 | 4/1931 | Norway | 2/94 |
| 2001237 | 1/1979 | United Kingdom | 2/251 |

*Primary Examiner*—Werner H. Schroeder
*Assistant Examiner*—Sara M. Current
*Attorney, Agent, or Firm*—Donald W. Hanson

[57] ABSTRACT

A meshy garment designed to warm desired portions above the waist of the body of the user. A meshy garment according to the invention is in the form of a vest or a shirt comprising a folded portion at the bottom of the garment, said folded portion being divided into a number of chambers to form so many pockets in each of which a heating device such as a disposable body warmer can be removably accommodated.

6 Claims, 4 Drawing Sheets

MESHY GARMENT

BACKGROUND OF THE INVENTION

This invention relates to a meshy garment designed to warm desired portions above the waist of the body of a user.

There have been known various types of heating devices such as a disposable body warmer (hereinafter simply referred to body warmer) utilizing iron powder which is oxidized by air in the presence of water or moisture in the air. Such disposable body warmers are very popular and widely used because they do not require the use of fire and are lightweight.

While such a disposable body warmer is normally placed in a pocket of a garment when it is used, it is accompanied by a drawback that the location of placement is limited to the pockets of a garment and that it can not always be placed on the right position for heating. Moreover, such a body warmer can cause a low temperature burning on the body.

SUMMARY OF THE INVENTION

It is therefore an object of the invention to provide a meshy garment that can warm desired portions of the body of the user and at the same time has an excellent heat retaining property that can be exhibited even in cold districts and areas.

Another object of the invention is to provide a meshy garment that can be used with multi-layered bags having temperature adjustment capability and designed to accommodate disposable body warmers.

The above objects and other objects as well as advantages of the invention will become apparent through the following description which is made by referring to the accompanying drawings that illustrate several preferred embodiments of the invention.

BRIEF DESCRIPTION OF THE DRAWINGS

In the accompanying drawings:

FIG. 1(*b*) is a back view of the embodiment;

FIG. 1(*c*) is a front view of the embodiment;

FIG. 2(*b*) is a back view of the embodiment;

FIG. 2(*c*) is a front view of the embodiment;

DETAILED DESCRIPTION OF THE INVENTION

A meshy garment according to the invention is achieved by forming a folded portion at the bottom of a meshy garment in the form of a vest or a shirt, the folded portion being divided into a number of chambers to form so many pockets in each of which a heating device such as a disposable body warmer can be removably accommodated.

Now the invention will be described in greater detail by referring to the accompanying drawings.

Figure 1:
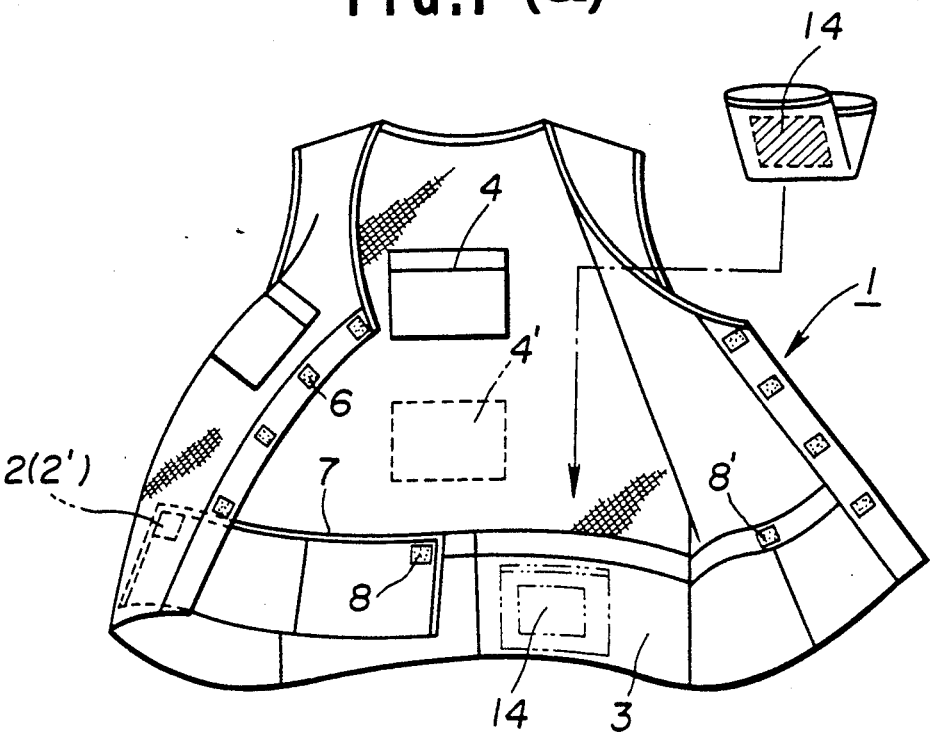
FIG. 1(*a*) is a perspective view illustrating the inside of an embodiment of the invention.
Figure 1:
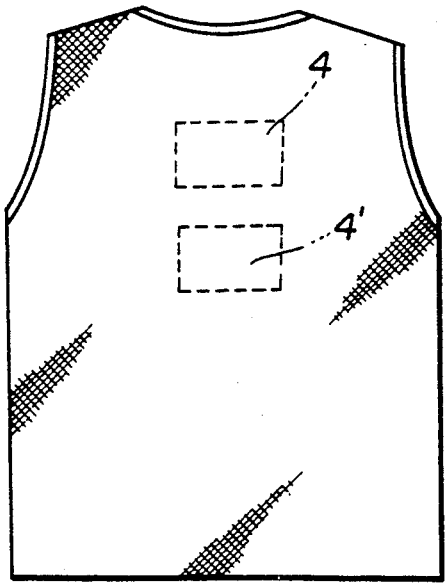
Figure 1:
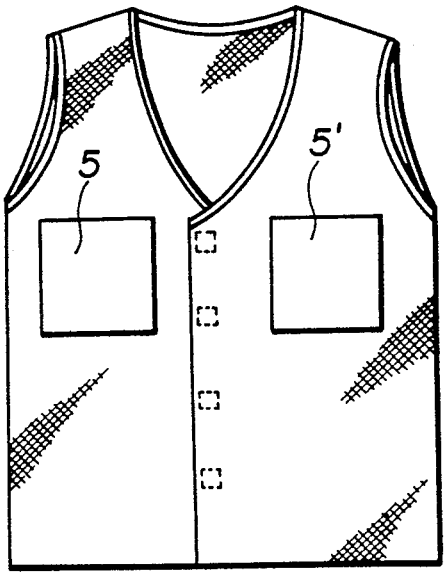

In FIG. 1 showing a perspective view of an embodiment of the invention, a folded portion is formed at the bottom of a vest 1 made of meshwork of textile and separated at the front. The folded portion is divided into a number of chambers 3 each of which is designed to accommodate a body warmer and has an opening at its upper end so that a disposable body warmer can be removably placed therein. Similar pockets for accommodating body warmers 4, 4' and 5, 5' are also provided on the inside of the back and chest portions of the vest.

The separable front edges of the vest 1 are provided with a number of VELCRO fasteners (magic tape pieces) 6 so that they can be separably bound together. At the bottom of the separated front members of the vest, there is a provided removable pocket 7 that has an opening at the top and is attached to the front members by means of VELCRO fasteners 2, 2' and 8, 8' for accommodating a body warmer. The position of the pocket 7 can be moved by shifting the binding positions of the VELCRO fasteners 2, 2' and 8, 8'. With such an arrangement with which a pocket 7 can be attached to the position extending over both front members of the vest, the front center of the body of the user can be selectively warmed when the user desires to obtain an maximum comfort particularly by warming the stomach and accelerating digestion of the food therein.

Since a garment according to the invention is realized by using as meshwork of textile, it provides an excellent retention of heat if it is borne between underwear and a jacket and does not deteriorate heat emission of the disposable body warmer as it does not block air circulation around the body.

It should be noted that a meshy garment according to the invention can be put on inside out with a view to reduce the heat transmitted by a body warmer to the body depending on the ambient temperature and the position of the body warmer.

Figure 2:
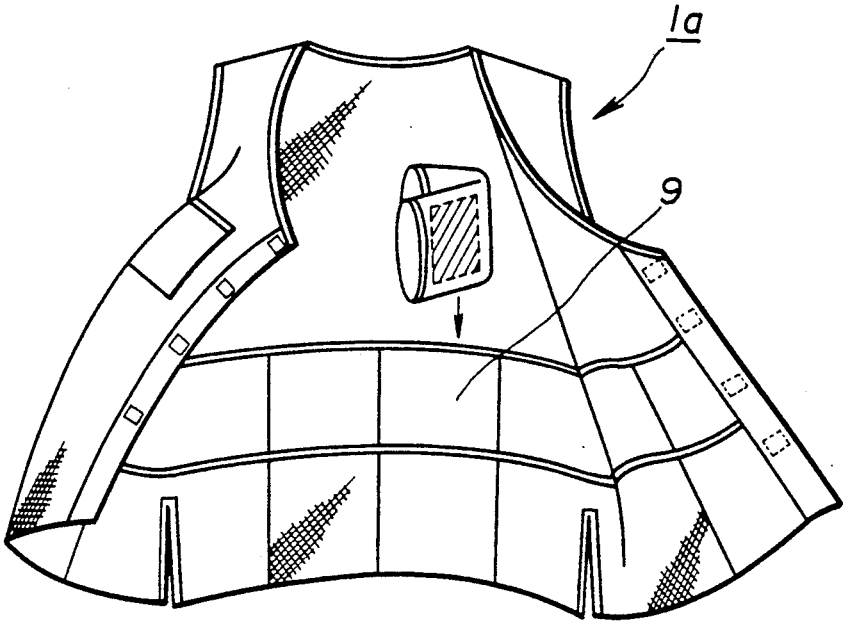
FIG. 2(*a*) is perspective view illustrating the inside of another embodiment of the invention.
Figure 2:
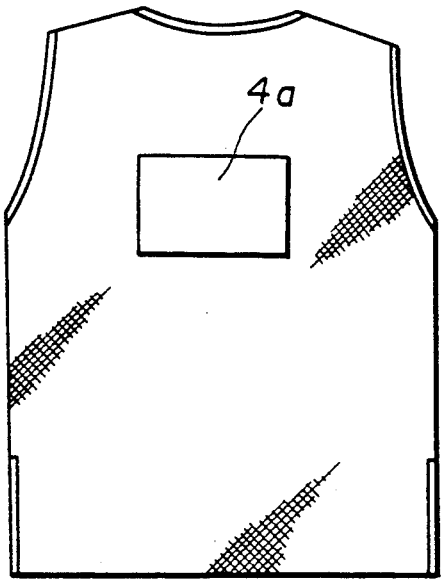
Figure 2:
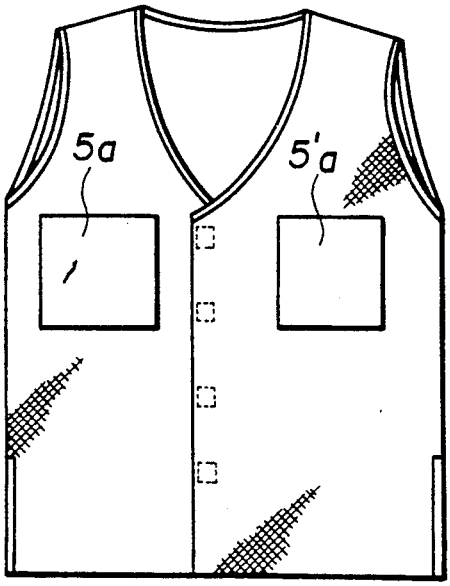

FIG. 2 is a perspective view of another embodiment of the invention comprising a series of additional pockets 9 formed above the folded portion of the garment in such a manner that they encircle the user's body and they have an opening at the upper end.

Figure 3:
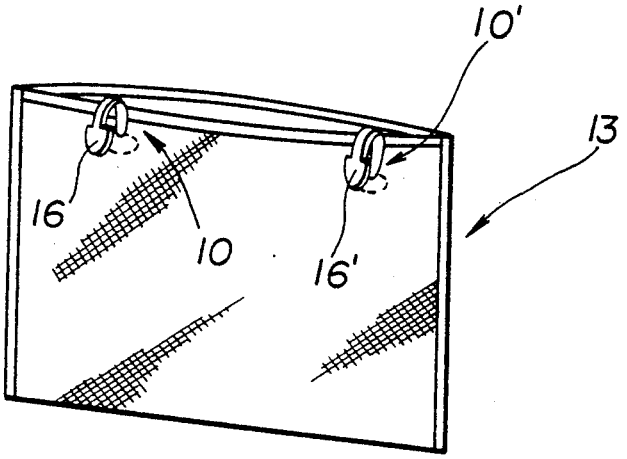
FIG. 3 is a perspective view of a displaceable pocket that can be conveniently used with a meshy garment according to the invention.
Figure 4:
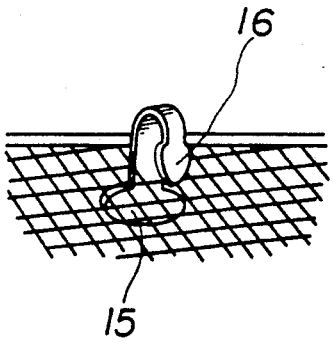
FIG. 4 is an enlarged view illustrating the condition in which a displaceable pocket is held to a meshy garment by a holder.
Figure 6:
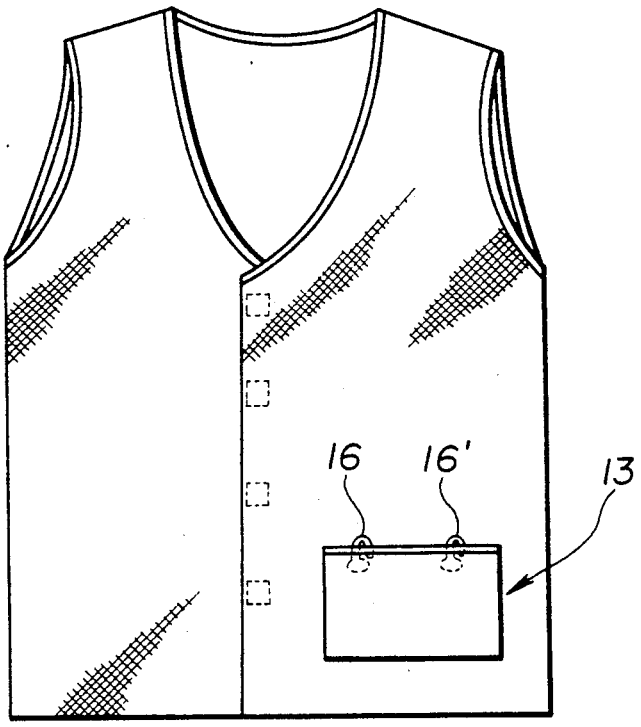
FIG. 6 is a perspective view illustrating a meshy garment according to the invention which is equipped with a displaceable pocket.

FIG. 3 illustrates a displaceable pocket 13 designed to achieve a second object of the invention. The pocket 13 comprises a pair of hook-shaped holders 10, 10' fitted to one of the separated upper edges of the pocket 13 made of meshwork of textile by means of their respective oblong fitting portions 15 (see FIG. 4) which are rigidly fitted to the meshwork of the pocket in such a manner that the holders 10, 10' are rising vertically along the side surface of the pocket 13. Each of the holders 10, 10' can be fitted to a pocket by passing its tip 16 through the meshwork and then rigidly attaching the fitting portion 15 to the meshwork as shown in FIG. 4. The pocket 13 may be rigidly fitted to a desired position of a meshy garment by making the holder tips 16, 16' pass through the meshy garment so that they are hung by the meshwork as illustrated in FIG. 6.

Figure 5:
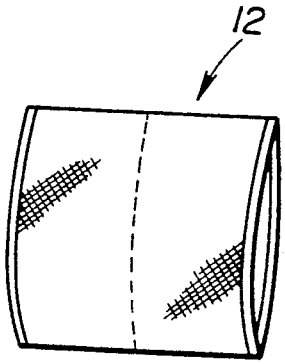
FIG. 5 is a perspective view illustrating a bag shaped member which is conveniently used for temperature adjustment of a body warmer in a meshy garment according to the invention.

FIG. 5 is a perspective view of a bag-shaped body 12 for temperature adjustment that can be removably attached to a pocket of a meshy garment of the invention. As illustrated, such a bag-shaped body 12 is of a meshwork material and is in the form of a sleeve that has two open ends and is sewed together at the middle. It is used by folding it at the middle with the openings directed upward as shown in FIG. 1 or left or right as shown in FIG. 2 and then put in any one of the pockets of a meshy garment in order to reduced the heat transmitted to the body.

As is apparent from the above description, one or more than one body warmers can be used at proper positions of a body by using a meshy garment according to the invention to comfortably warm the body so that the user can be warmed without wearing a large number of underwear garments even in a cold district or cold location and causing low temperature burning to the body. Since a garment according to the invention is made of meshwork, it does not block air circulation nor heat emission of a body warmer and exhibits an excellent heat retaining property when put on between a jacket and underwear garment.

What is claimed is:

1. A meshy garment of meshwork material for accommodating a heating device such as a disposable body warmer, the garment adapted to be worn about the upper torso of a wearer and comprising a folded portion at the bottom of the garment, said folded portion being divided into a number of chambers to form a plurality of pockets in each of which a disposable body warmer generating heat in the presence of air can be movably accommodated, and a bag-shaped body for heat adjustment of a disposable body warmer in the form of a sleeve having open ends and sewed together at its middle removably contained in one of the pockets, the garment further including a movable pocket made of meshwork of textile removably attached to a desired position on the garment by a pair of hook-shaped holders rigidly fitted to the pocket which are inserted into openings of the meshwork of the garment so that the pocket is hung by the meshwork.

2. A meshy garment according to claim 1, wherein said garment further includes a number of pockets sequentially formed above said folded portion.

3. A meshy garment according to claim 1 wherein said garment is separable at the front into two front members and a displaceable pocket is attached in a position extending between both front members on the interior of the garment to accommodate a disposable body warmer.

4. A meshy garment according to claim 1, further including a body warmer in a chamber of the garment.

5. A meshy garment according to claim 4, wherein the body warmer generates heat by the oxidation of iron particles.

6. A garment according to claim 1 wherein the bag-shaped body is of a meshwork of textile material.

* * * * *